US011011040B2

(12) United States Patent
Wight et al.

(10) Patent No.: US 11,011,040 B2
(45) Date of Patent: May 18, 2021

(54) ELECTRONIC PERSONAL DOSIMETER SMART ACCESSORY SYSTEM

(71) Applicant: Ontario Power Generation Inc., Toronto (CA)

(72) Inventors: Jason Wight, Toronto (CA); Clive Bands, Toronto (CA); Katarzyna Izdebska, Toronto (CA); Ahmed Abdelsamie, Toronto (CA)

(73) Assignee: Ontario Power Generation, Inc., Toronto (CA)

( * ) Notice: Subject to any disclaimer, the term of this patent is extended or adjusted under 35 U.S.C. 154(b) by 50 days.

(21) Appl. No.: 16/242,200

(22) Filed: Jan. 8, 2019

(65) Prior Publication Data

US 2019/0213863 A1 Jul. 11, 2019

Related U.S. Application Data

(60) Provisional application No. 62/615,232, filed on Jan. 9, 2018.

(51) Int. Cl.

| | |
|---|---|
| ***G08B 21/12*** | (2006.01) |
| ***G08B 5/36*** | (2006.01) |
| ***G08B 25/10*** | (2006.01) |
| ***G08B 25/01*** | (2006.01) |

(52) U.S. Cl.

CPC ..... *G08B 21/12* (2013.01); *G08B 5/36* (2013.01); *G08B 25/016* (2013.01); *G08B 25/10* (2013.01)

(58) Field of Classification Search

CPC ..... G08B 1/08; G08B 21/12; G08B 25/016; G08B 25/10; G08B 5/36; G08B 7/06

See application file for complete search history.

(56) References Cited

U.S. PATENT DOCUMENTS

| | | | | |
|---|---|---|---|---|
| 5,045,700 | A * | 9/1991 | Crowson | G01T 1/185 250/336.1 |
| 9,390,600 | B1 * | 7/2016 | Sirotkin | G08B 1/08 |
| 10,191,289 | B2 * | 1/2019 | Bhardwaj | G06F 1/1656 |
| 2006/0039577 | A1 * | 2/2006 | Sanguino | H04R 25/558 381/315 |
| 2009/0007259 | A1 * | 1/2009 | Argott | G06F 21/6209 726/21 |
| 2011/0077909 | A1 * | 3/2011 | Gregory | G01N 21/00 702/187 |

(Continued)

*Primary Examiner* — Omer S Khan

(74) *Attorney, Agent, or Firm* — Calfee, Halter & Griswold LLP

(57) ABSTRACT

An electronic personal dosimeter (EPD) smart accessory system is described. The system includes a first component configured to be attachable to the EPD and a second component configured to be attachable to safety glasses. The first component includes an ambient light sensor and a first communication module. The ambient light sensor detects light from a light-emitting diode (LED) of the EPD to detect a warning signal from the EPD. The second component includes a feedback mechanism and a second communication module. The first communication module establishes a short range wireless communication connection with the second communication module, and transmits a signal to cause the second component to turn on the feedback mechanism when the warning signal from the EPD is detected.

20 Claims, 6 Drawing Sheets

(56) References Cited

U.S. PATENT DOCUMENTS

| | | | | |
|---|---|---|---|---|
| 2012/0329517 | A1* | 12/2012 | Elin | H04M 1/72403 455/556.1 |
| 2013/0063557 | A1* | 3/2013 | Saigo | H04N 13/341 348/42 |
| 2015/0102928 | A1* | 4/2015 | Sirotkin | G08B 1/08 340/545.1 |
| 2015/0185505 | A1* | 7/2015 | Das | G02C 7/083 349/13 |
| 2016/0123802 | A1* | 5/2016 | Likovich | G01J 1/0271 356/221 |
| 2017/0289670 | A1* | 10/2017 | Gilbertson | H04R 1/1083 |
| 2020/0197098 | A1* | 6/2020 | Chopra | G06F 3/011 |

* cited by examiner

ELECTRONIC PERSONAL DOSIMETER SMART ACCESSORY SYSTEM

CROSS-REFERENCE TO RELATED APPLICATIONS

This application claims priority under 35 U.S.C. § 120 from U.S. Provisional Patent Application No. 62/615,232 filed on Jan. 9, 2018. The entire contents of this priority application is incorporated herein by reference.

TECHNICAL FIELD

The present disclosure relates to methods and systems for providing feedback from an electronic personal dosimeter.

BACKGROUND

Nuclear power plants worldwide have a common goal: to protect their workers from unanticipated radiation exposure while workers are performing their duties in a radioactive environment. Devices, such as electronic personal dosimeters (EPDs), are used extensively in the nuclear industry to alert workers that they are approaching the radiation dose limit for a specific task. EPDs may monitor exposure to radiation in real time and emit alarms so that workers can react quickly to back out from their location when the workers have reached a maximum limit of radiation exposure level.

EPDs are required to be worn on the worker's chest in order to detect exposure of the worker's vital organs (which are located near the chest) to gamma radiation. Besides wearing EPDs to protect workers in the radioactive environment, other apparel and equipment, such as a plastic suit, hearing protection, and other such items, are also required to be worn while performing tasks. However, it is a challenge for workers to see visual warning indications (e.g., warning lights from light emitting diodes (LEDs)) from EPDs located on the workers' chest while workers are wearing such apparel and other equipment. Further, workers may fail to be alerted by audible alarms from EPDs in the case where workers are in a noisy environment and are wearing hearing protections.

Thus, solutions to monitor and indicate EPD's status in a timely and accurately manner are desired.

SUMMARY

The present disclosure describes example approaches that enable an electronic personal dosimeter (EPD) smart accessory system to provide warning indications to a worker without requiring any change to conventional EPDs and safety glasses worn by a worker. In at least some examples, methods and systems for providing warning indications to a worker who is wearing an EPD and a pair of safety glasses are provided, which may help to indicate the status of the EPD, such as whether a main LED of the EPD is turned on, in a more direct and timely manner.

According to one example aspect, the present disclosure describes an electronic personal dosimeter (EPD) smart accessory system that includes a first component configured to be attachable to an EPD and a second component configured to be attachable to safety glasses. The first component includes an ambient light sensor and a first communication module. The ambient light sensor is configured to detect light from a light-emitting diode (LED) of the EPD to detect a warning signal from the EPD. The second component includes a feedback mechanism and a second communication module. The first communication module is configured to establish a short range wireless communication connection with the second communication module. The first communication module is further configured to transmit a signal over the wireless communication connection to cause the second component to turn on the feedback mechanism when the warning signal from the EPD is detected.

According to another example aspect, the present disclosure describes an electronic personal dosimeter (EPD) smart accessory system that includes a short range wireless communication enabled EPD, and a second component configured to be attachable to safety glasses. The short range wireless communication enabled EPD includes a first communication module. The second component includes a feedback mechanism and a second communication module. The first communication module is configured to establish a short range wireless communication connection with the second communication module. The first communication module is further configured to transmit a signal over the wireless communication connection to cause the second component to turn on the feedback mechanism when a warning signal is generated by the short range wireless communication enabled EPD.

According to another example aspect, the present disclosure describes an electronic personal dosimeter (EPD) smart accessory system that includes a first component configured to be attachable to an EPD and short range wireless communication enabled safety glasses. The first component includes an ambient light sensor and a first communication module. The ambient light sensor is configured to detect light from a light-emitting diode (LED) of the EPD to detect a warning signal from the EPD. The short range wireless communication enabled safety glasses includes a feedback mechanism, and a second communication module. The first communication module is configured to establish a short range wireless communication connection with the second communication module. The first communication module is further configured to transmit a signal over the wireless communication connection to cause the short range wireless communication enabled safety glasses to turn on the feedback mechanism when the warning signal from the EPD is detected.

BRIEF DESCRIPTION OF THE DRAWINGS

For a more complete understanding of the present invention, and the advantages thereof, reference is now made to the following description taken in conjunction with the accompanying drawings, in which.

Similar reference numerals may have been used in different figures to denote similar components.

DETAILED DESCRIPTION OF ILLUSTRATIVE EMBODIMENTS

Conventional methods to alert workers that they are approaching a radiation dose limit may be inconvenient. It may be difficult for a worker to see the electronic personal dosimeter (EPD)'s visual warning signals or to hear the EPD's warning signals, for example because protective apparel and other equipment may prevent workers from seeing or hearing such warning signals. The disclosed methods and systems may help to provide warning indications to workers in a more accessible and convenient manner.

An EPD is an electronic device that has a number of sophisticated functions, such as continual monitoring of radiation, generation of warning signals at preset dose levels, and providing live readout of dose accumulated. These functions are especially useful in high dose areas where residence time of the worker is limited due to dose constraints. The dosimeter can be reset, usually after taking a reading for record purposes, and thereby re-used multiple times.

Prior to commencing a task, EPDs are programmed to preset a maximum dose rate as well as a maximum cumulative dose a worker may receive during working activities. To protect workers in a radioactive environment, EPDs are required to be worn on workers' chest where vital organs are located. In many situations, the workers are required to wear one or more other apparel and equipment as well, such as plastic suits, air-supplied horn, masks, standard personnel protective equipment (PPE) (e.g., including hard hat, safety glasses and hearing protection) and other items based on the nature of the work.

However, wearing a plastic suit makes it very difficult for a worker to be able to see a light emitting diode (LED) warning signal on the EPD located on the worker's chest. As such, it may not be readily obvious to the worker that he has reached his maximum cumulative dose. Instead, the worker has to continuously and iteratively check the EPD to ensure that he is within the programmed maximum dose rate and the maximum cumulative dose while he is occupied with his task. This can pose a hazard to the worker.

Moreover, workers' duties in nuclear power plants vary significantly. For many maintenance activities, workers are required to use both of their hands, which may make it difficult to check the EPD's status, especially with other apparel and equipment that they are wearing concurrently.

Figure 1A:
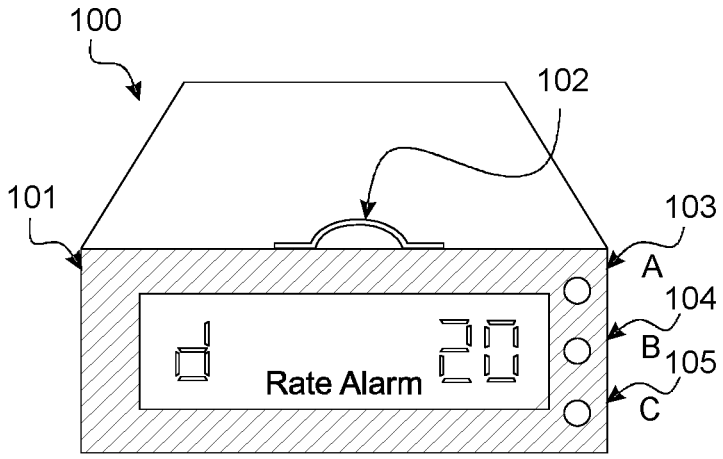
FIG. 1A is a front perspective view of an example electronic personal dosimeter (EPD)

FIG. 1A provides a front perspective view of an example EPD 100. Although an example EPD is illustrated and discussed below, this is only illustrative and is not intended to be limiting. In other examples, the EPD may be any other suitable EPD and may have different configurations. The EPD 100 is a small, lightweight, gamma-radiation monitoring device that is designed to be worn on a worker's body and keep a live record of radiation dose and dose rate of the worker. The EPD 100 incorporates a top mounted liquid crystal display (LCD) 101 and multiple alarm indicators. The multiple alarm indicators include an 85 dB audible alarm, a forward facing, ultra-bright LED 102 (referred to as a main LED 102), and a trio of alarm LEDs on the front face of the EPD. The trio of alarm LEDs comprise a red flash LED 103 which indicates standard alarms and alarm warning signals, a green flash LED 104 which indicates gamma and x-ray dose increment at preset intervals, and a blue flash LED 105 which provides secondary dose indication, such as Hp(0.07) dose level or neutron increments at preset intervals. In some example embodiments, the status of the EPD may be defined by whether the main LED 102 is turned on, whether the audible alarm is turned on, whether the red flash LED 103 is turned on, whether the green flash LED 104 is turned on, and/or whether the blue flash LED 105 is turned on.

Figure 1B:
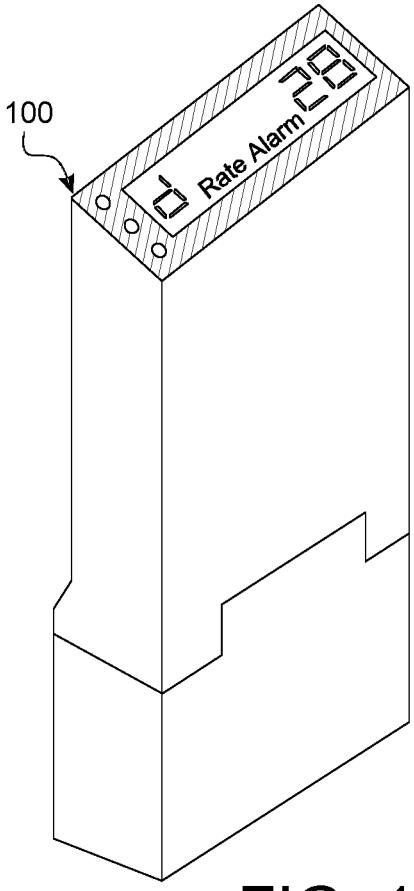
FIG. 1B is a top perspective view of the EPD of FIG. 1A, with an attachable module.
Figure 1C:
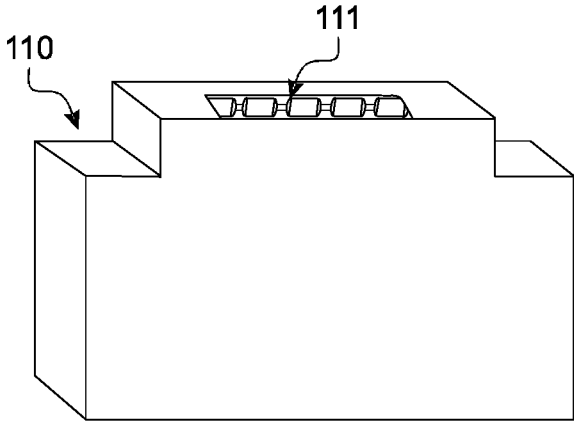
FIG. 1C is a partial perspective view of the attachable module of FIG. 1B.

FIG. 1B presents a top perspective view of the example EPD 100 of FIG. 1A, with an example attachable module 110 to expand the communication capabilities of the EPD 100. FIG. 1C presents a partial perspective view of the example attachable module 110. The attachable module 110 includes a telemetry module 111 which may establish a Bluetooth (BT) communication connection to supplemental alarm accessories. Systems for providing indications to a worker who is wearing an EPD and a pair of safety glasses, as disclosed herein, may be used to provide warning signals to the worker in a direct and timely manner.

Figure 2:
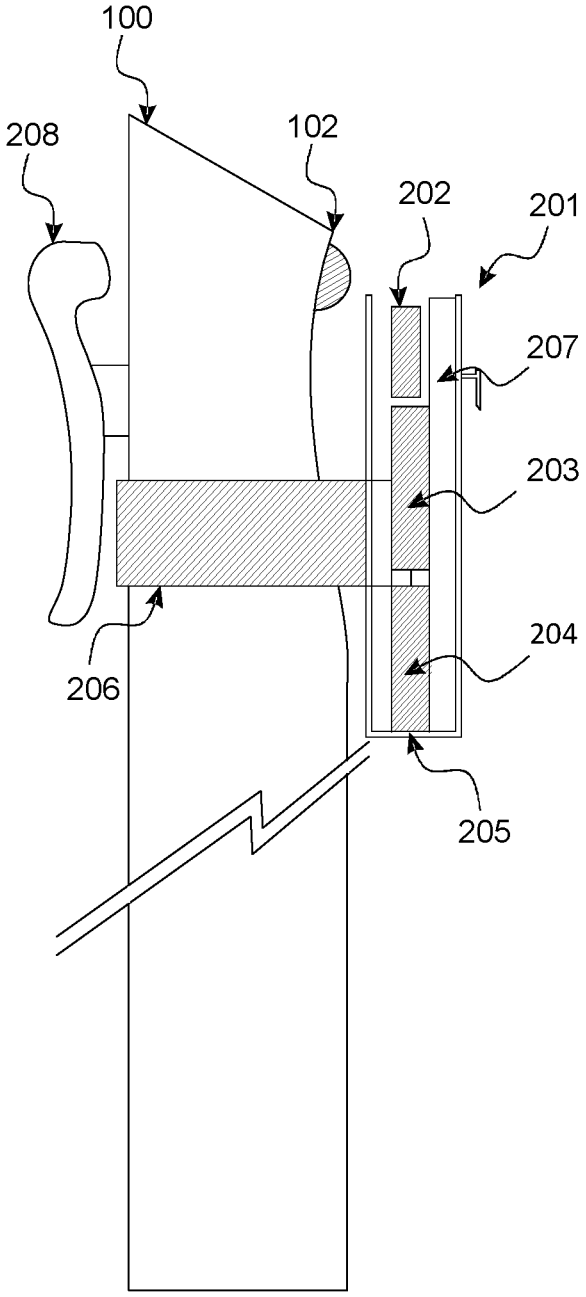
FIG. 2 is a side view of a first component of a EPD smart accessory system clipped on an EPD according to example embodiments of the disclosure.

FIG. 2 illustrates a perspective view of a first component of an EPD smart accessory system, in accordance with example embodiments disclosed herein, attached to the EPD 100. The first component 201 incorporates an attachment mechanism (e.g., a device clip 206) and a plastic enclosure 205. An ambient light sensor 202, a first communication module 203 and a power source (e.g., a coin battery 204) are provided on a printed circuit board (PCB) 207 in the plastic enclosure 205. The EPD 100 has an EPD belt clip 208 which enables the EPD 100 to be worn by workers. The first component 201 is attachable to the EPD 100 via the device clip 206. As shown in FIG. 2, the ambient light sensor 202 of the first component 201 is configured to detect the warning signals from the main LED 102 of the EPD 100 (e.g., the ambient light sensor 202 may be positioned to directly face the main LED 102 of the EPD 100 when the first component 201 is attached to the EPD 100). A configuration that aligns the main LED 102 and the ambient light sensor 202 face to face may help the first component 201 to detect warning signals from the main LED 102 without blocking the worker's vision of the main LED 102. By way of non-limiting example, in one possible configuration, the first communication module 203 is a Bluetooth low energy (BLE) module integrated with a microcontroller unit (MCU).

Figure 3:
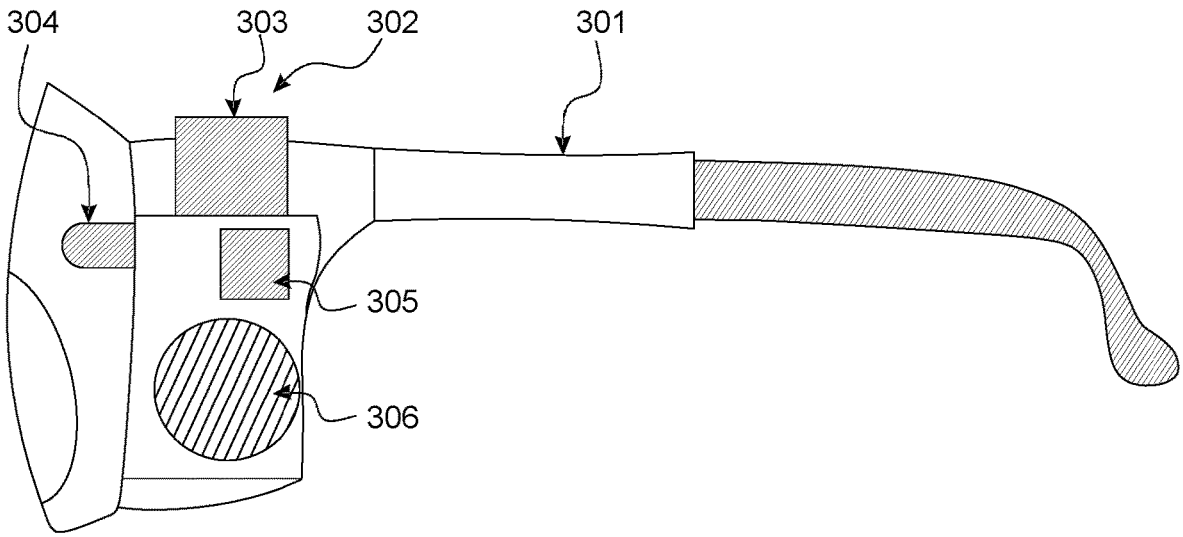
FIG. 3 is a side view of a second component of a EPD smart accessory system clipped on a pair of safety glasses according to example embodiments of the disclosure.

FIG. 3 is a perspective view of a second component of the EPD smart accessory system, in accordance with example embodiments disclosed herein, attached to a pair of safety glasses 301. The second component 302 includes an attachment mechanism (e.g., a glasses clip 303), a feedback mechanism (e.g., a LED 304), a second communication module 305 and a power source (e.g., a coin battery 306). The second component 302 is attachable to the safety glasses 301 via the glasses clip 303. The LED 304 is located at a place where the worker can see a light emitted by the LED 304 directly. By way of non-limiting example, in one possible configuration, the second communication module 305 is a BLE module integrated with a MCU.

The first component 201 may communicate with the second component 302 over a short range wireless communication connection, such as BLE communication connection, established between the first communication module 203 and the second communication module 305, as disclosed herein. The communications between the first and second components 201, 302 may be short range and low energy, such that they do not interfere with existing wireless systems in the field. Although a BLE communication connection is illustrated and discussed below, this is only illustrative and is not intended to be limiting. In other examples, the short range wireless communication connection may be any other suitable connection, including ZigBee.

Figure 4:
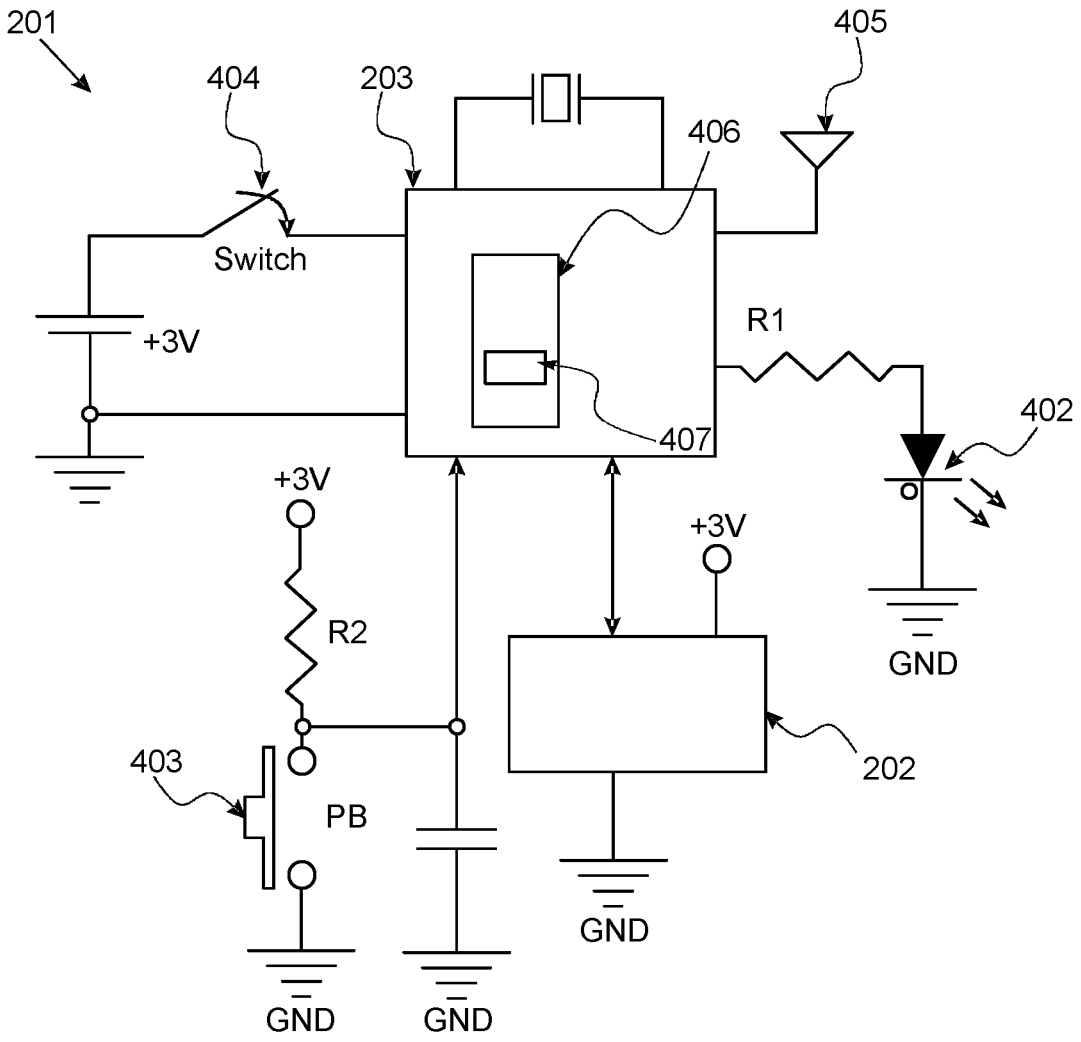
FIG. 4 shows a schematic diagram of an example circuit in the example first component of FIG. 2 according to example embodiments of the disclosure.

Referring to FIG. 4, an example circuit of the first component 201 will be described in greater detail. FIG. 4 shows connections among components provided on the PCB 207 within the first component 201. The first component 201 also includes an ON/OFF switch 404, a pushbutton (PB) 403 and a power indicator (e.g., a LED 402). The ON/OFF switch 404 is electrically connected to the first communication module 203 to turn the first component 201 on or off. As presented in FIG. 4, the first communication module 203 includes a BLE module 406 which is integrated with a MCU 407. The PB is used to facilitate BLE pairing between the first component 201 and the second component 302. The LED 402 is associated to the first communication module 203 to indicate whether the first component 201 is turned on. While the LED 402 is turned on, the LED 402 is an indicator that indicates the first component 201 is turned on. In some example embodiments, the LED 402 flashes (e.g., at a rate of 5 times per second) while BLE pairing is being established between the first component 201 and the second component 302. In some other example embodiments, the LED 402 flashes (e.g., at a rate of 2 times per second) if the voltage of the coin battery 204 is lower than a pre-programmed value.

The first communication module 203 may establish communication with the ambient light sensor 202 over an Inter-integrated Circuit (I2C), a Serial Peripheral Interface (SPI) or other suitable interface. The first communication module 203 may be electrically connected to a crystal oscillator 401, to enable data processing with a precise frequency. A first antenna 405 is electrically connected to the first communication module 203 to enable wireless communication, for example transmit generated messages or processed data from the first component 201 to the second component 302, and receive generated messages or processed data from the second component 302 to the first component 201.

Figure 5:
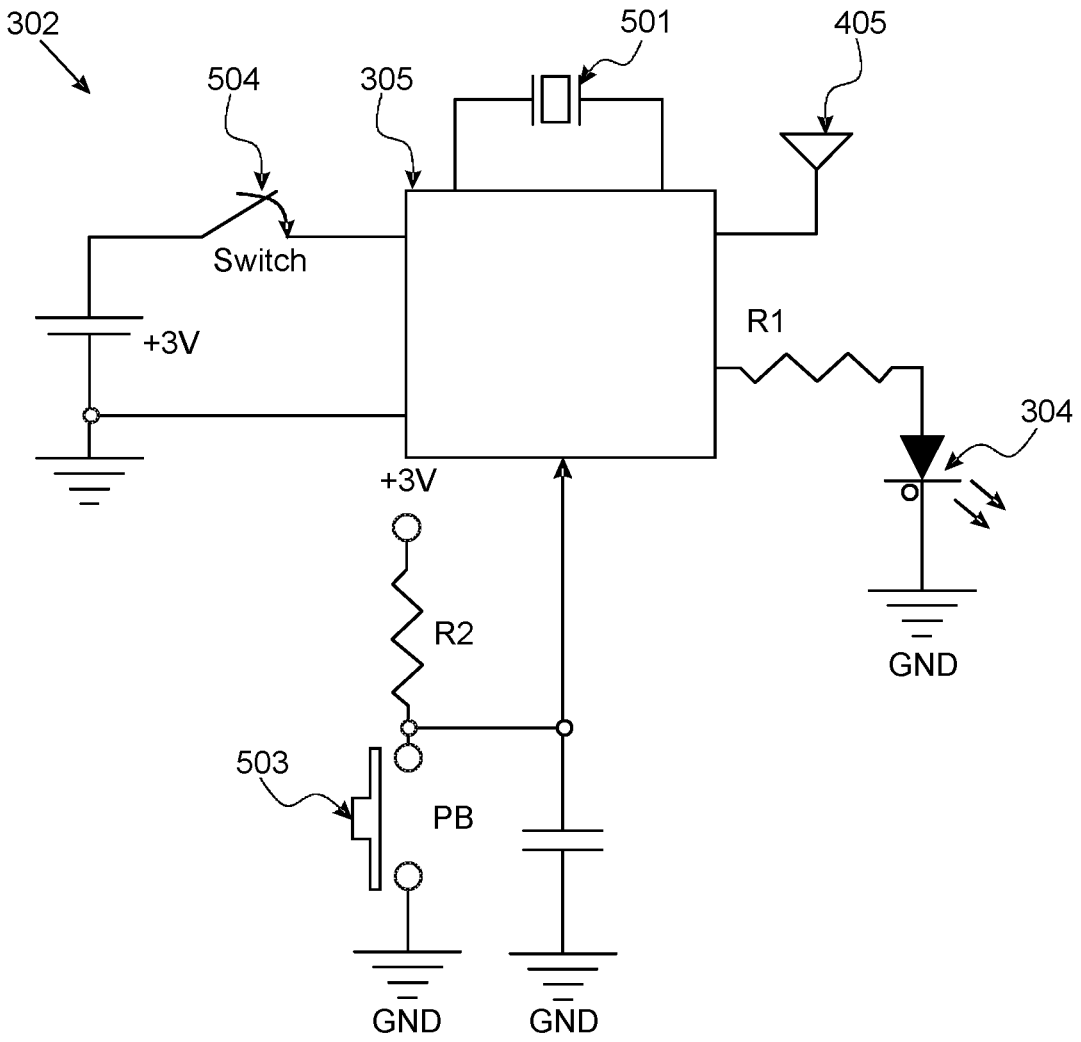
FIG. 5 is a schematic diagram of an example circuit in the example second component of FIG. 3 according to example embodiments of the disclosure.

With reference to FIG. 5, an example circuit of the second component 302 will be described in greater detail. FIG. 5 shows connection among components provided on a PCB within the second component 302. A crystal oscillator 501, a second antenna 505, an ON/OFF switch 504, a pushbutton (PB) 503 and a feedback mechanism (e.g., LED 304) are mounted on a PCB within the second component 302. By way of non-limiting example, in one possible configuration, the functions of the crystal oscillator 501, the second antenna 505, the second communication module 305, the ON/OFF switch 504, and the PB 503 for the second component 302 are similar to the functions of counterparts of the first component 201.

In the illustrated example, the first component 201 and the second component 302 are included in an EPD smart accessory system. A worker who is wearing an EPD and a pair of safety glasses may use the EPD smart accessory system to receive indications from the EPD. In use, the first component 201 may be attached to the EPD 100 such that the ambient light sensor 202 is positioned to detect light from the main LED 102 of the EPD 100, and the second component 302 may be attached to the safety glasses such that the feedback mechanism (e.g., the LED 304) is easily detectable by the worker wearing the safety glasses. After the first component 201 and the second component 302 are turned on by the ON/OFF switches 404,504 respectively, the first communication module 203 within the first component 201 establishes a BLE communication connection with the second communication module 305 within the second component 302.

When the worker is approaching the radiation dose limit, the main LED 102 of the EPD 100 is turned to red, indicating a warning signal. The ambient light sensor 202 of the first component 201 detects that the main LED 102 is turned to red. The MCU 407 within the first communication module 203 generates a first signal (e.g., a human interface device (HID) message) in response to detecting that the main LED 102 is turned to red. The first communication module 203 transmits the first signal to the second communication module 305 over the BLE communication connection via the first antenna 405. After the second communication module 305 processes the received first signal, the LED 304 is controlled to turn on, to enable the worker to see a warning signal. Although the LED 304 has been described as the feedback mechanism on the second component 302, in other example embodiments, other feedback mechanisms may be used, such as an audio alarm, a vibrating alarm or combinations of different modes of feedback.

In some example embodiments, when the worker backs out from a position that exceed the maximum dose rate, the main LED 102 of the EPD 100 is turned off. The ambient light sensor 202 of the first component 201 detects that the main LED is turned off. The MCU 407 within the first communication module 203 then generates a second signal (e.g., another HID message) in response to detecting that the main LED 102 is turned off. The first communication module 203 transmits the second signal to the second communication module 305 over the BLE communication connection via the first antenna 405. After the second communication module 305 processes the received second signal, the LED 304 is controlled to turn off, to enable the worker to see that the warning signal is turned off. As noted above, other feedback mechanisms may be used, to similarly inform the worker that the warning signal is off.

The main LED 102 of the EPD 100 and the LED 304 of the second component 302 may have the same color, such as red, to enable the LED 304 of the second component 302 to mimic performance of the main LED 102 of the EPD 100. Such an EPD smart accessory system, which mimics visual indications provided by the EPD 100, may allow the worker to keep track of all the indications generated by the EPD 100 in a more accessible and timely manner.

Figure 6:
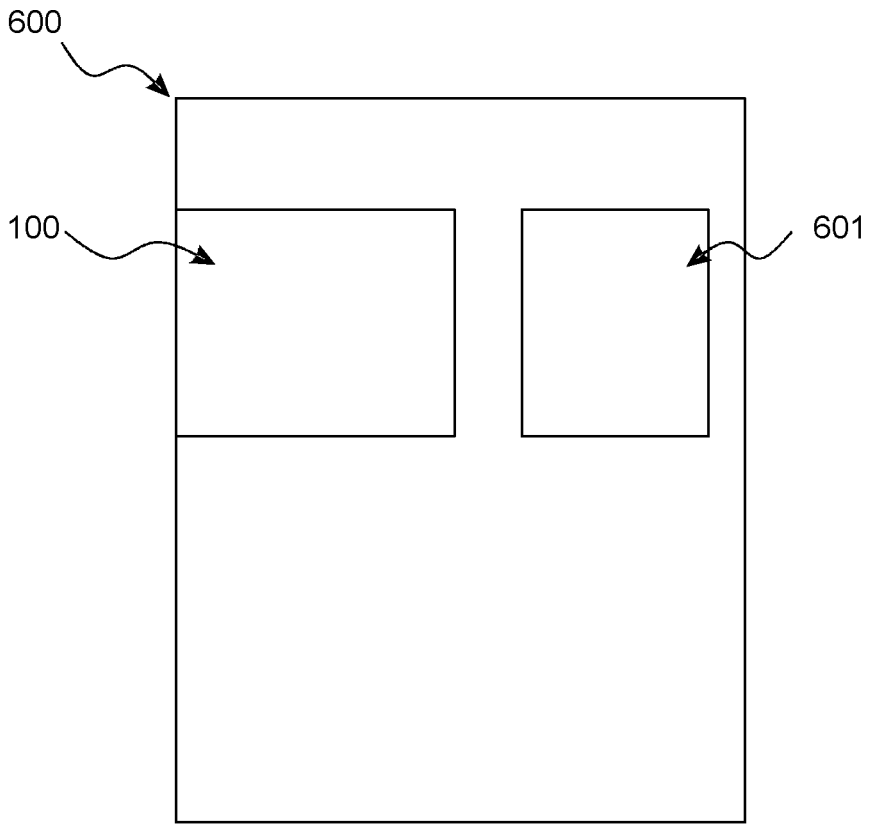
FIG. 6 is a diagram of an example short range wireless communication enabled EPD according to example embodiments of the disclosure.

Although FIG. 2 shows the first component clipped on an EPD, it can be appreciated that in an alternative example embodiment, functions of the first component may be instead integrated into a short range wireless communication enabled EPD 600 as shown in FIG. 6. The short range wireless communication enabled EPD 600 comprises all the functions and components of the example EPD 100 discussed above and additionally a wireless communication module 601. The wireless communication module 601 may establish a short range wireless communication connection with the second communication module 305 of the second component 302, similar to the first communication module 203 of the first component 201, as discussed above. When the short range wireless communication enabled EPD 600 is used, the first component 201 may be omitted from the EPD smart accessory system.

In use, a worker may wear the short range wireless communication enabled EPD 600 and the second component 302 attached to a pair of safety glasses. When the worker is approaching the radiation dose limit, the main LED 102 of the EPD 100 is turned on, to indicate a warning signal. At the same time, the wireless communication module 601 sends a message to the second component 302 over the short range wireless communication connection, to cause the second component 302 to provide a similar indication. In accordance with a received message, the second component 302 operates to provide indications to a worker, as discussed above.

Although FIG. 3 shows the second component clipped on a pair of glasses, it can be appreciated that in an alternative example embodiment, functions of the second component may be instead integrated into a pair of safety glasses together (such as in a frame) to form a pair of short range wireless communication enabled safety glasses. For example, the second communication module and the feedback mechanism of the second component may be integrated into the short range wireless communication enabled safety glasses. Functions of the short range wireless communication enabled safety glasses include all the functions of the second component and all the functions of conventional safety glasses. While a worker is wearing the short range wireless communication enabled safety glasses, the operation of the short range wireless communication enabled safety glasses is similar to the operation of the second component 302 which is clipped to the safety glasses 301, as described above.

In some example embodiments, other signals, in addition to warning signals, may also be indicated to the worker using the disclosed EPD smart accessory system. For example, other specific LED colors and/or flash rates may be used for communication between supervisors and workers. A supervisor may transmit a message to a specific worker by controlling the short range wireless communication enabled EPD 600 or the first component 201 (e.g., via long range wireless communication) to cause a desired signal to be display by the second component 302, while the specific worker is performing his duties. The EPD smart accessory system may provide a flexible, programmable interface to allow programming of customized alerts (e.g., alerts based on dynamic radiation values that can vary in different scenarios).

In the present disclosure, methods and EPD smart accessory systems for providing indications of an EPD are described. The EPD smart accessory system enables visual indications from the EPD to be provided closer to the worker's eyes. Providing visual indications in front of the worker's eyes may help the worker to focus on his task efficiently instead of checking EPD's status continuously and iteratively. The disclosed system also allows audio indications from the EPD to be provided to the worker in a way that allows the worker to recognize the indications even in a noisy environment. The short range wireless communication connection between the first component and the second components, such as the BLE communication connection, may be short range and low energy, so that the communications do not interfere with existing wireless systems in usage in the field. The first component may be omitted where the EPD itself is capable of short range wireless communications, as described above. The first component may be designed to be attachable to a variety of different EPDs. The second component may be designed to be attachable to a variety of different safety glasses on the market. In some embodiments, the second component may be integrated into the safety glasses (e.g., in the frame).

Certain adaptations and modifications of the described embodiments can be made. Therefore, the above discussed embodiments are considered to be illustrative and not restrictive. Although this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

The invention claimed is:

1. A portable electronic personal dosimeter (EPD) smart accessory system comprising:

a first component configured to be releasably securable to an EPD to be worn by an individual, the EPD being one of a plurality of different EPDs;

the first component including an ambient light sensor and a first communication module, the ambient light sensor configured to detect light from a light-emitting diode (LED) of the EPD to detect a warning signal from the EPD, the first component also including a power indicator indicating whether the first component is turned on; and a second component configured to be releasably securable to safety glasses to be worn by the individual, the safety glasses being one of a plurality of different safety glasses;

the second component including a feedback mechanism and a second communication module;

wherein the first communication module is configured to establish a short range wireless communication connection with the second communication module, the first communication module being further configured to transmit a signal over the wireless communication connection to cause the second component to turn on the feedback mechanism when the warning signal from the EPD is detected; and wherein the power indicator is coupled to the first communication module and is configured to flash while the short range wireless communication is being established between the first component and the second component.

2. The EPD smart accessory system of claim 1, wherein the system further comprises the EPD.

3. The EPD smart accessory system of claim 1, wherein the first communication module and the second communication module are Bluetooth Low Energy (BLE) modules, and the short range wireless communication is a BLE communication connection.

4. The EPD smart accessory system of claim 3, wherein each of the first communication module and the second communication module is integrated with a microcontroller unit (MCU).

5. The EPD smart accessory system of claim 1, wherein the first component comprises a device clip for clipping the first component onto any one of the plurality of different EPDs, and the second component comprises a glasses clip for clipping the second component onto any one of the plurality of different safety glasses.

6. The EPD smart accessory system of claim 1, wherein the first component includes a first ON/OFF switch to turn the first component on or off, and the second component includes a second ON/OFF switch to turn the second component on or off.

7. The EPD smart accessory system of claim 1, wherein the first component includes a first pushbutton (PB) to facilitate short range wireless communication pairing between the first communication module and the second communication module, and the second component includes a second PB to facilitate short range wireless communication pairing between the first communication module and the second communication module.

8. A portable electronic personal dosimeter (EPD) smart accessory system comprising:

a short range wireless communication enabled EPD adapted to be worn by an individual, the EPD including a first communication module and a power indicator indicating whether the EPD is turned on; and a second component configured to be releasably securable to safety glasses to be worn by the individual, the safety glasses being one of a plurality of different safety glasses;

the second component including a feedback mechanism and a second communication module;

wherein the first communication module is configured to establish a short range wireless communication connection with the second communication module, and the first communication module is further configured to transmit a signal over the wireless communication connection to cause the second component to turn on the feedback mechanism when a warning signal is generated by the short range wireless communication enabled EPD; and wherein the power indicator is coupled to the first communication module and is configured to flash while the short range wireless communication is being established between the EPD and the second component.

9. The EPD smart accessory system of claim 8, wherein the first communication module and the second communication module are Bluetooth Low Energy (BLE) modules, and the short range wireless communication is a BLE communication connection.

10. The EPD smart accessory system of claim 8, wherein the second component comprises a glasses clip for clipping the second component onto any one of the plurality of different safety glasses.

11. The EPD smart accessory system of claim 8, wherein the feedback mechanism is a LED and the LED of the second component and a warning LED of the short range wireless communication enabled EPD have same color.

12. The EPD smart accessory system of claim 8, wherein the short range wireless communication enabled EPD includes a first ON/OFF switch to turn the short range wireless communication enabled EPD on or off, the second component includes a second ON/OFF switch to turn the second component on or off.

13. The EPD indicating system of claim 8, wherein the short range wireless communication enabled EPD includes a first pushbutton (PB) to facilitate short range wireless communication pairing between the first communication module and the second communication module, the second component includes a second PB to facilitate short range wireless communication pairing between the first communication module and the second communication module.

14. A portable electronic personal dosimeter (EPD) smart accessory system comprising:

a first component configured to be releasably securable to an EPD to be worn by an individual, the EPD being one of a plurality of different EPDs;

the first component including an ambient light sensor and a first communication module, the ambient light sensor configured to detect light from a light-emitting diode (LED) of the EPD to detect a warning signal from the EPD, the first component also including a power indicator indicating whether the first component is turned on; and a pair of short range wireless communication enabled safety glasses to be worn by the individual, the safety glasses including a feedback mechanism, and a second communication module;

wherein the first communication module is configured to establish a short range wireless communication connection with the second communication module, the first communication module being further configured to transmit a signal over the wireless communication connection to cause the short range wireless communication enabled safety glasses to turn on the feedback mechanism when the warning signal from the EPD is detected; and wherein the power indicator is coupled to the first communication module and is configured to flash while the short range wireless communication is being established between the first component and the safety glasses.

15. The EPD smart accessory system of claim 14, wherein the system further comprises the EPD.

16. The EPD smart accessory system of claim 14, wherein the first communication module and the second communication module are Bluetooth Low Energy (BLE) modules, and the short range wireless communication is a BLE communication connection.

17. The EPD smart accessory system of claim 14, wherein the first component comprises a device clip for clipping the first component onto any one of the plurality of different EPDs.

18. The EPD smart accessory system of claim 1, wherein the power indicator is configured to flash at a first frequency while the short range wireless communication is being established, and to flash at a second frequency when a power level of a power source of the first component is lower than a pre-programmed value.

19. The EPD smart accessory system of claim 1, wherein the first communication module is further configured to receive a communication signal over a long-range wireless communication connection from a remote device, and transmit the communication signal over the short-range wireless communication connection to cause the short-range wireless communication enabled safety glasses to activate the feedback mechanism to convey an alert.

20. The EPD smart accessory system of claim 18, wherein the feedback mechanism is a LED, and the LED is configured to convey the alert as flashing or colour change in response to the communication signal from the first communication module.

* * * * *